US010688369B2

(12) United States Patent
Madonna, Jr.

(10) Patent No.: US 10,688,369 B2
(45) Date of Patent: Jun. 23, 2020

(54) LACROSSE FACE-OFF/DRAW CONTROL TRAINING DEVICE

(71) Applicant: X FACTOR LACROSSE, LLC, Liverpool, NY (US)

(72) Inventor: Dominick A. Madonna, Jr., Liverpool, NY (US)

(73) Assignee: X FACTOR LACROSSE, LLC, Liverpool, NY (US)

( * ) Notice: Subject to any disclaimer, the term of this patent is extended or adjusted under 35 U.S.C. 154(b) by 0 days.

(21) Appl. No.: 15/843,517

(22) Filed: Dec. 15, 2017

(65) Prior Publication Data

US 2019/0184260 A1 Jun. 20, 2019

(51) Int. Cl.

| | |
|---|---|
| ***A63B 69/40*** | (2006.01) |
| ***A63B 1/00*** | (2006.01) |
| *A63B 102/14* | (2015.01) |

(52) U.S. Cl.
CPC ..... *A63B 69/40* (2013.01); *A63B 1/00* (2013.01); *A63B 2102/14* (2015.10)

(58) Field of Classification Search
CPC ..... A63B 69/40; A63B 69/00
USPC ..... 473/446, 471, 454, 430, 422, 228, 218
See application file for complete search history.

(56) References Cited

U.S. PATENT DOCUMENTS 6,290,618 B1 * 9/2001 Ring ..... A63B 69/0002 473/422
9,789,374 B2 * 10/2017 Trombley ..... A63B 69/00

* cited by examiner

*Primary Examiner* — John E Simms, Jr.
*Assistant Examiner* — Rayshun K Peng
(74) *Attorney, Agent, or Firm* — Bond Schoeneck & King, PLLC; George McGuire

(57) ABSTRACT

A lacrosse face-off training device having a base with at least first and second legs. The first leg extends at least partially along a longitudinal axis. An arm is mounted to the base for rotation about a rotation axis that is perpendicular to the longitudinal axis. A resistance member extends between the arm and the second leg.

8 Claims, 4 Drawing Sheets

LACROSSE FACE-OFF/DRAW CONTROL TRAINING DEVICE

BACKGROUND OF THE INVENTION

Field of the Invention

The invention relates to a training device specifically for the sport of Lacrosse, both Indoor and Outdoor Variations, and more particularly to a Face-Off or Draw training device.

One very unique aspect of lacrosse is the nature of the way possession works. After each goal is scored a face-off or draw is conducted in which it is most common for the team of the winner of the draw or face-off to gain possession. Due to the importance of possession in the sport of lacrosse, the face-off or draw puts much importance on the athlete participating in the face-off or draw. It is therefore important for such a player to become as proficient at this aspect of the game as possible so as to allow a team to control the outcome of a game by maintaining initial possession after each goal as often as possible.

The Men's Face-Off, as stated above, occurs after a goal is scored and takes place in the center of the field. One player from each team approaches the Face-Off location with the back of their "crosse" (head), lined up facing the opponents crosse. The ball is then placed between the two crosses and the referee will announce the cadence followed by the sound of a whistle on which the two players compete for the ball.

While the Face-Off occurs on the ground, the Women's Draw occurs with both players standing upright with the ball nested between the backs of each crosse. The rest of the Draw proceeds similarly to a Face-Off with a referee cadence followed by a whistle.

A major part of winning a Face-Off is being able to beat the opponent to the clamp. The clamp is a move where the athlete pinches the ball between the rails on the crosse of the stick. This move allows the Face-Off player to now direct where the ball will go, which typically is to the Face-Off player himself or one of his teammates. While there are other techniques to secure a Face-Off this has proved to be one of the most efficient, repeatable and controllable technique.

When one is taking a Face-Off or Draw against an opponent there are a few important components that the athlete can utilize in order to increase the chances of securing possession of the ball. These components are the following: Powerful base to resist opponent, quick and powerful hands to beat the opponent to the clamp, as well as, the ability to rotate about the ball to win the clamp.

SUMMARY OF THE INVENTION AND ADVANTAGES

The subject invention comprises a method and apparatus for simulating a Face-Off in order to practice the components described above in an efficient and productive manner.

In one embodiment, a lacrosse face-off training device comprises a base having at least first and second legs, with the first leg extending at least partially along a longitudinal axis; an arm mounted to the base for rotation about a rotation axis that is perpendicular to the longitudinal axis; and a resistance member extending between the arm and the second leg.

In one aspect, the lacrosse face-off training device further comprises a plurality of pointed cleats mounted to said base.

In another aspect, the lacrosse face-off training device further comprises a third leg extending between the first and second legs of the base.

In another aspect the lacrosse face-off training device further comprises a weighted wall attached to the base.

In a further aspect the lacrosse face-off training device further comprises a lacrosse head attached to the arm.

In another aspect, wherein the arm comprises an L-shaped bracket having a long arm and a short arm, and the short arm includes an opening formed therethrough.

In a further aspect the opening formed through the short leg is elongated in shape.

In a further aspect the lacrosse face-off training device further comprises a tubular member mounted to one side of said first leg and a resistance band mounting post mounted to the opposite side of said first leg.

In a further aspect, the lacrosse face-off training device further comprises a pivot post mounted to the first leg, wherein the tubular member is adapted to be rotationally engaged with the pivot post.

In a further aspect the first leg is mounted in spaced relation to the base.

In another aspect the training device also comprises a head attachment that provides the ability to be used with varying head designs and set to any angle to increase the difficulty of the face-off against the device. The manner in which this operates is the head attachment contains a threaded core which uses a meshing bolt to allow for the head to be set and locked into any position. Finally, the component of the machine that allows for resistance is an elastic band set up which connects the rotation arm to the base of the machine. This not only transmits the force from the athlete into the machine, but also allows for there to be varying degrees of difficulty depending on the band that is attached to the machine. Allowing for flexibility above ages and skill level, increasing the usability of the system.

BRIEF DESCRIPTION OF THE DRAWINGS

These and other features and advantages of the present invention will become more clear and understood by referencing the following detailed descriptions and accompanying drawings, wherein.

DETAILED DESCRIPTION OF THE PREFERRED EMBODIMENT

Figure 1:
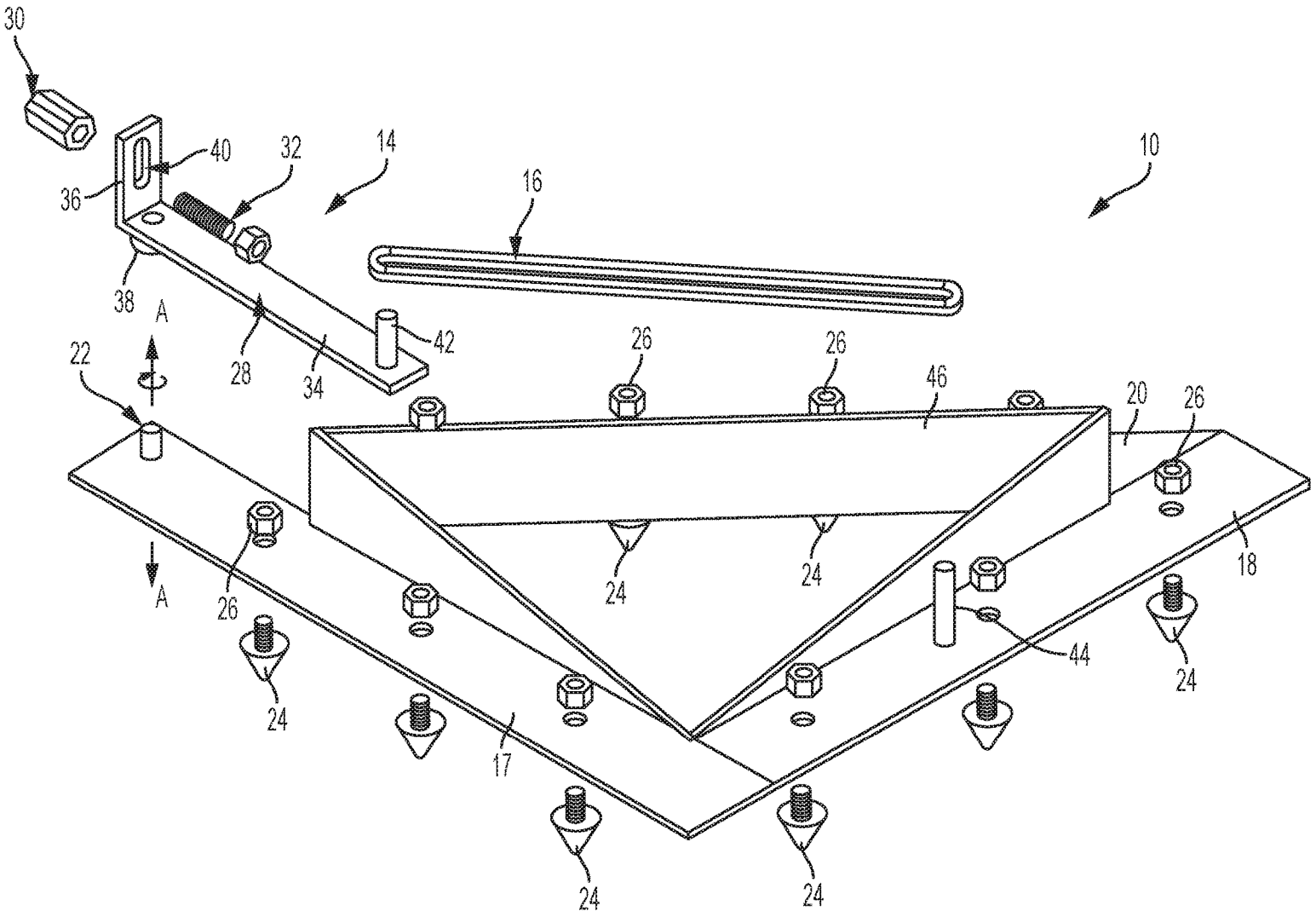
FIG. 1 is an exploded perspective view of a face-off training device in accordance with an embodiment of the present invention.
Figure 2:
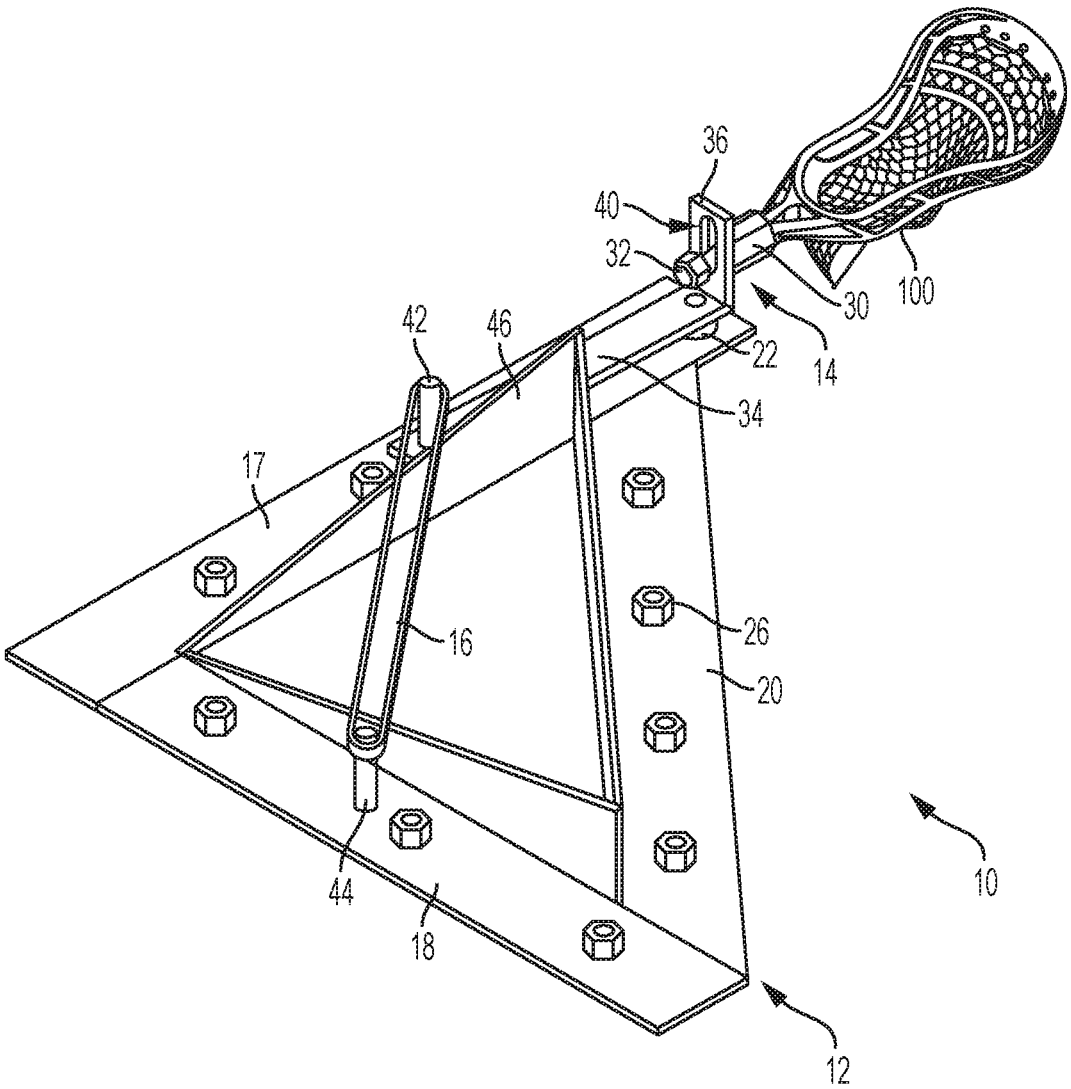
FIG. 2 is a perspective view of a face-off training device in accordance with an embodiment of the present invention.
Figure 3:
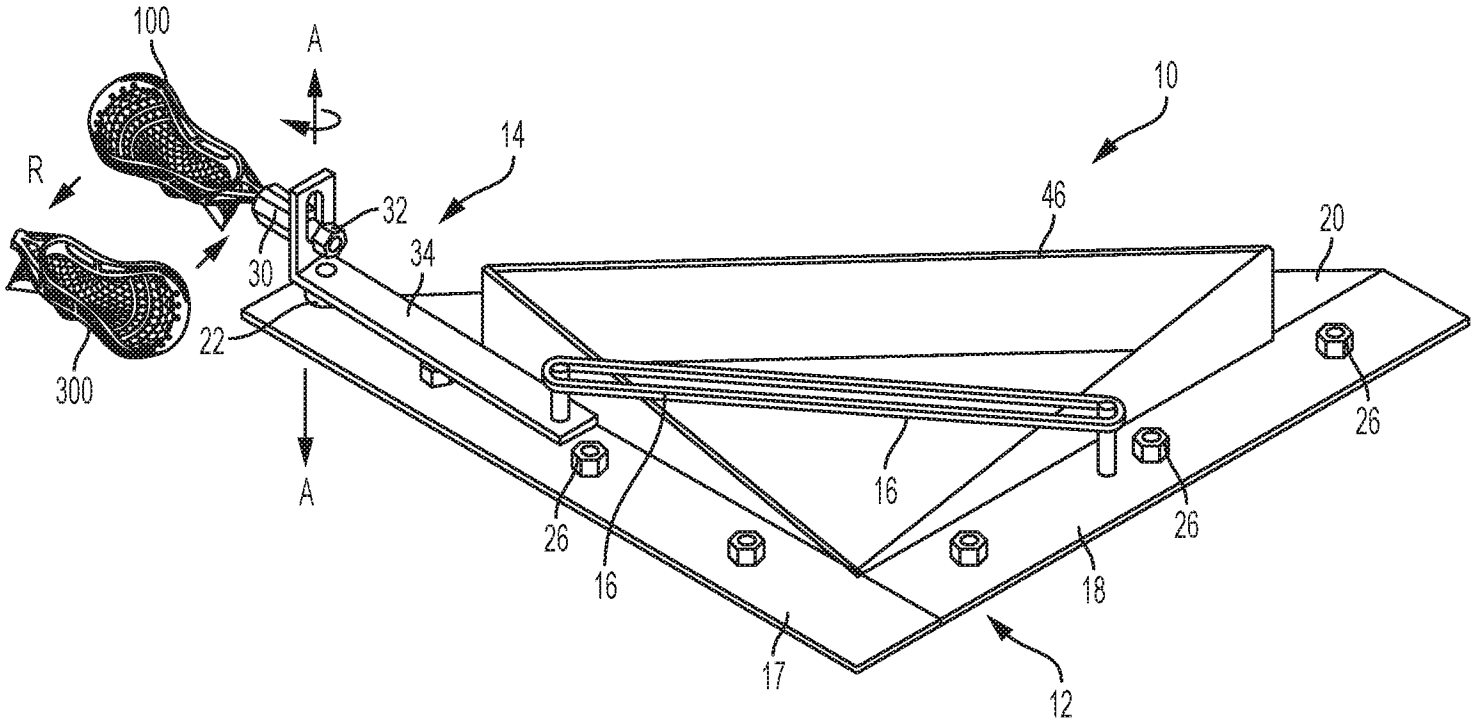
FIG. 3 is a perspective view of a face-off training device in accordance with an embodiment of the present invention.
Figure 4:
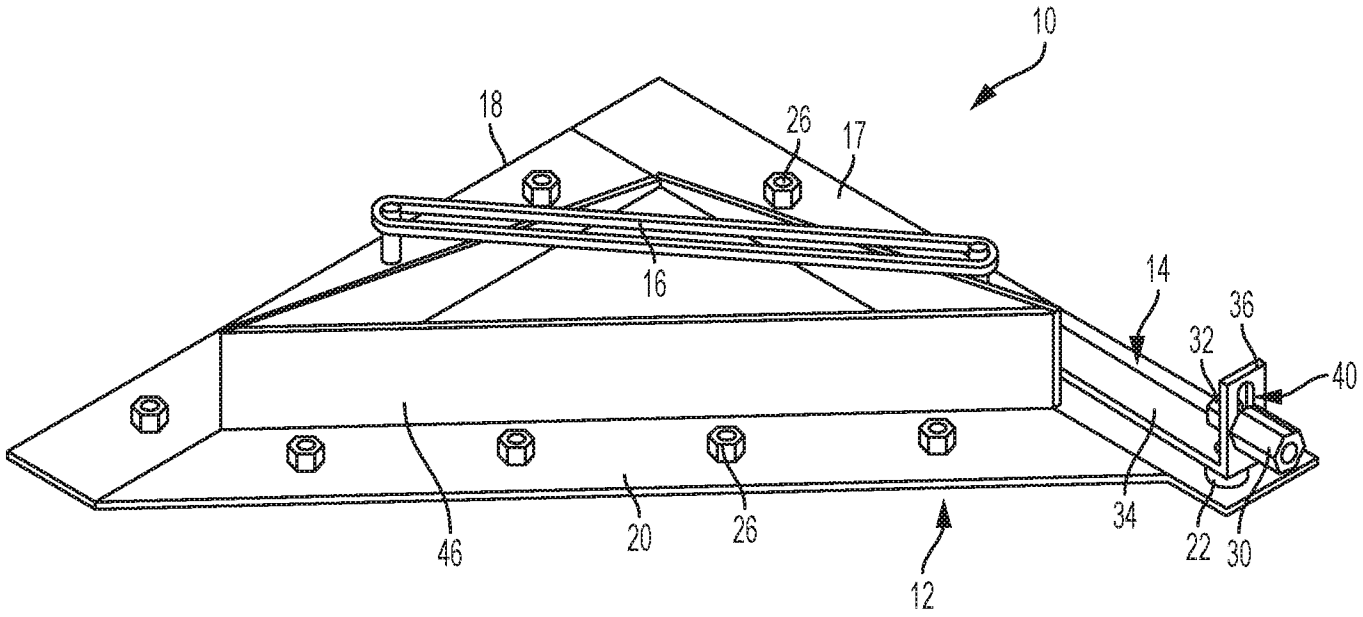
FIG. 4 is a perspective view of a face-off training device in accordance with an embodiment of the present invention.

Referring to the Figures, wherein like numerals indicate like or corresponding parts throughout, there is seen in FIG. 1 a lacrosse face-off or draw training device, designated generally by reference numeral 10, essentially comprising a base 12, an arm assembly 14 that securely retains the head of a lacrosse stick thereon and is adapted to forcefully move in a rotational path simulative of a face-off motion, and a actuating band 16 that provides a force to arm 14 causing it to rotate. Collectively, these members provide a face-off or draw training device to permit repetitive training to a lacrosse faceoff or draw specialist.

The base 12, which is represented throughout FIGS. 1-4, is defined geometrically in such a way to aid in realistic simulation of the face-off. Base 12 is of a generally triangular shape comprising first and second legs 17, 18 integrally joined at essentially a right angle to one another, and a third leg 20 extending between the other ends of the first and second legs 17, 18. A slightly elongated pivot rod 22 is fixedly secured towards the end of leg 17 that is adjacent leg 20 and extends upwardly along a longitudinal axis A-A. Mounted in staggered relation along the bottom of legs 17, 18, and 20 are pointed cleats 24 that can be secured to base 12 via respective nuts 26. Cleats 24 provide ground engaging elements to assist in minimizing any movement of device 10 when in use and external forces are applied thereto.

Arm assembly 14 comprises an L-shaped bracket 28, a lacrosse head connector 30, and a threaded rod 32 for securing the head connector to a lacrosse head. L-shaped bracket 28 includes the longer leg 34 and shorter leg 36 that extends perpendicularly outwardly from one end of leg 34. A tubular member 38 is attached to the downwardly facing surface of leg 34 towards the end thereof that is adjacent to and on the opposite side of shorter leg 36. Tubular member 38 engages pivot rod 22 and is rotationally movable relative thereto about axis A-A. Further features of arm assembly 12 include an elongated opening 40 formed through shorter leg 34 that provides for adjustable (angular and height-wise) mounting of a lacrosse head 100, and a resistance band mounting post 42 that extends upwardly from leg 34 towards the end thereof that is opposite leg 36.

A final element of arm assembly 12 is a second resistance band post 44 mounted at an intermediate position along and extending upwardly from leg 18. Optionally, weighted walls 46 may be welded or otherwise attached to legs 17, 18, and 20 to add stabilizing weight to device 10 (the walls may not be necessary if the legs are composed of material that is of sufficient weight to make use of the walls unnecessary). Walls 46 taper downwardly to provide clearance for band 14 as it stretches between posts 42 and 44.

In its assembled and ready to use form, tubular member 38 is engaged over pivot rod 22 with leg 34 extending in slightly spaced relation over and in axial alignment with leg 16. Resistance band 16 is stretched to extend in tension between posts 42 and 44. A lacrosse head 100 is attached to connector 30 at the desired height and angle and device 10 is ready for use.

In use a lacrosse ball 200 is placed on the side of lacrosse head 100 that is on the opposite side of base 12, and a player practicing face-offs can position himself/herself in face-off position. The player can then apply force on the ball 200 and lacrosse head 100 which causes the resistance band 16 to proceed further in tension and lacrosse head 100 to pivot about axis A-A with the reaction force R being applied to the practicing player's lacrosse head 300. Once the ball 200 is moved out of engagement with the lacrosse head 100 the player can reset the ball and repeat the face off drill.

To alter the amount of force needed to move lacrosse head 100, bands 16 of different resistances can be used and/or multiple bands may be used.

What is claimed is:

1. A lacrosse face-off training device, comprising:

a. a base having at least first and second legs, said first leg extending at least partially along a longitudinal axis;

b. an arm assembly mounted to said base for rotation about a rotation axis that is perpendicular to said longitudinal axis, said arm assembly comprising an L-shaped bracket that includes a longer leg and a shorter leg that extends perpendicularly outwardly from the longer leg, wherein the longer leg is attached to the first leg for rotation about an axis that is perpendicular to the longitudinal axis, and wherein the shorter leg includes an opening formed therethrough and wherein the longer leg of the L-shape bracket includes a downwardly facing surface to which a tubular member is mounted and an upwardly facing surface to which a resistance band mounting post mounted; and c. a resistance member extending between said arm and said second leg.

2. The lacrosse face-off training device according to claim 1, further comprising a plurality of pointed cleats mounted to said base.

3. The lacrosse face-off training device according to claim 1, wherein said base further comprises a third leg.

4. The lacrosse face-off training device according to claim 1, further comprising a weighted wall attached to said base.

5. The lacrosse face-off training device according to claim 1, further comprising a lacrosse head attached to said arm.

6. The lacrosse face-off training device according to claim 1, wherein said opening is elongated in shape.

7. The lacrosse face-off training device according to claim 1, further comprising a pivot post mounted to said first leg, wherein said tubular member is adapted to be rotationally engaged with said pivot post.

8. The lacrosse face-off training device according to claim 7, wherein said arm assembly is mounted in spaced relation to said base.

* * * * *